United States Patent [19]

Nerheim et al.

[11] Patent Number: 4,862,803

[45] Date of Patent: Sep. 5, 1989

[54] INTEGRATED SILICON SECONDARY EXPLOSIVE DETONATOR

[75] Inventors: Eldon Nerheim, Edina; Dave Hoff, Bloomington, both of Minn.

[73] Assignee: Honeywell Inc., Minneapolis, Minn.

[21] Appl. No.: 261,333

[22] Filed: Oct. 24, 1988

[51] Int. Cl.[4] ..... F42C 19/12

[52] U.S. Cl. ..... 102/202.5; 102/202.7

[58] Field of Search ..... 102/202.5, 202.7, 202.9

[56] References Cited

U.S. PATENT DOCUMENTS

| | | | |
|---|---|---|---|
| 4,471,697 | 9/1984 | McCormick et al. | 102/202.5 |
| 4,602,565 | 7/1986 | MacDonald et al. | 102/202.7 |
| 4,729,315 | 3/1988 | Proffit et al. | 102/202.5 |
| 4,788,913 | 12/1988 | Stroud et al. | 102/202.5 |

*Primary Examiner*—Charles T. Jordan

*Attorney, Agent, or Firm*—Haugen and Nikolai

[57] ABSTRACT

A detonator device for a primary or secondary explosive comprising an integrated circuit consisting of a silicon wafer substrate on which an epitaxial layer of a desired thickness is first grown, followed by a covering insulating oxide layer. Metal contacts are deposited on the oxide layer in a photolithographic masking process to form a regular pattern of contact pairs. These contact pairs are joined together by a bridge element which may be made from the same metal as the contacts, a higher density metal, from heavily doped polysilicon. The substrate is back-etched beneath the bridge members up to the epitaxial layer to form a barrel through which the flyer may travel. After the wafer is diced, the individual dies have a counter mass face-plate bonded atop the bridge and contacts.

6 Claims, 1 Drawing Sheet

INTEGRATED SILICON SECONDARY EXPLOSIVE DETONATOR

BACKGROUND OF THE INVENTION

I. Field of the Invention

This invention relates generally to devices for setting off an explosive charge, and more particularly to a slapper detonator fabricated by means of conventional integrated circuit processes whereby low-cost, highly reproducible and reliable devices can be readily manufactured.

II. Discussion of the Prior Art

Slapper detonators, per se, are known in the art. They comprise a device, which when initiated, cause a solid object to be propelled at high velocity against a secondary explosive medium, the impact creating a shock wave resulting in detonation of the secondary explosive. Such a device is disclosed in the McCormick et al Pat. No. 4,471,697. In this device, a pattern of metallization defines a bridge which, when vaporized by the application of a high current through it, creates a substantial pressure to propel a flyer through a barrel and against an initiating pellet to detonate that pellet. In the McCormick et al Patent, the flyer comprises a portion of the Kapton material on which the bridge elements are formed.

Another form of slapper detonator is described in the MacDonald et al Pat. No. 4,602,565 and in the references cited in the MacDonald et al patent.

SUMMARY OF THE INVENTION

The present invention describes a method for fabricating slapper detonators which principally utilizes standard integrated circuit fabrication techniques as well as the resulting product. By using such techniques, detonator devices can be fabricated, en masse and at very low cost, producing products of high reliability. Starting with a standard silicon wafer, an epitaxial layer of silicon of a predetermined thickness is grown on one surface of the wafer. Following that, an insulating layer, preferably silicon oxide, is grown on the epitaxial layer to a thickness in the range of from 3,000 to 7,000 Angstroms. Then a bridge member, which in accordance with the present invention, may comprise metal or heavily doped polysilicon is deposited followed by a metallizing step where a plurality of pairs of metal contacts are deposited on top of the insulating layer connecting to the ends of each bridge. Each unit is comprised of a bridge and two contacts, one on each end of the bridge.

An electro-chemical etching process is then used to back-etch the wafer to expose the epitaxial layer through the wafer and, in doing so, creating integral barrels. That is to say, the electro-chemical etch process etches away the unmasked silicon from the back side of the wafer at locations aligned with the bridge member and the etching stops when it reaches the epitaxial layer interface. As such, thin, uniform, silicon flyers are created which are in contact with the bridge members. In this fashion, a large plurality of detonator devices are created on the silicon wafer and subsequently after the back-etching process, the silicon wafers are cut into individual dies, each containing a bridge-barrel combination. Each of the dies then has a faceplate member as a counter-mass.

When a high voltage source is connected across the metal contacts of the detonator die, the metal or polysilicon bridge is instantaneously vaporized, resulting in the formation of a plasma arc which is confined by the face plate and which creates a large pressure shock wave effective to shear the silicon flyer at its interface with the back-etched barrel and to send it with high velocity down the barrel and, upon impacting with a secondary explosive, e.g., fine grain HNS pellet, causes a shock-wave detonation thereof.

Because integrated circuit techniques are employed, another important feature centers upon the use of such techniques to integrate additional electronic circuitry onto the silicon die. Such additional circuitry may include that for switching or directing control of the high currents provided to the slapper detonator bridge also on the same die. In this regard, reference is made to application Ser. No. 182,378, filed Apr. 18, 1988, and entitled "INTEGRATED SILICON PLASMA SWITCH" FIGS. 9 and 10 of that application show the manner in which the plasma switch may be used to initiate operation of a slapper detonator. In accordance with the present invention, both the plasma switch and the slapper detonator may be formed on the same silicon substrate. Additionally, the silicon die may be used to integrate other electronic sensors or control circuits.

OBJECTS

It is accordingly a principal object of the present invention to provide an improved slapper detonator for use with explosives.

Another object of the invention is to provide a slapper detonator produced utilizing integrated circuit techniques.

Another object of the invention is to provide a method of fabricating slapper detonators in which they are mass produced on silicon wafers and later separated to form a plurality of silicon dies, each including an integrally formed barrel and supporting the vaporizable bridge.

Yet another object of the invention is to provide an integrated circuit slapper detonator in which additional switching or control circuitry is fabricated on the same silicon die as the slapper detonator.

These and other objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
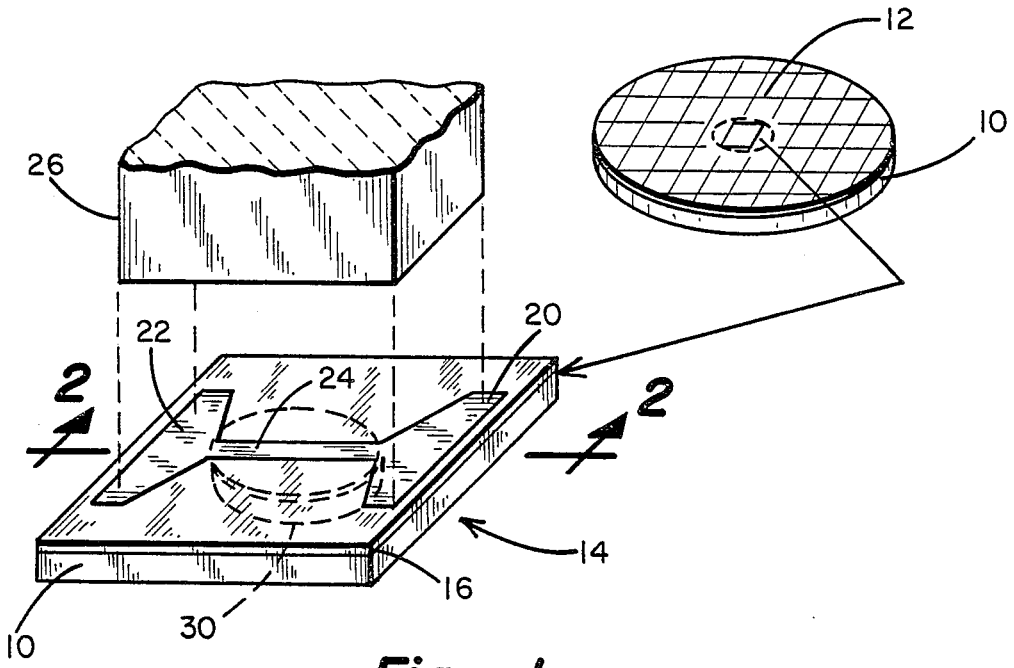
FIG. 1 is a perspective drawing of a silicon wafer and a typical die taken therefrom where the die incorporates the detonator of the present invention.

The integrated silicon secondary explosive detonator of the present invention is created through the use of standard integrated circuit techniques and, in this regard, in FIG. 1 is shown a silicon wafer which is a single-crystal substrate previously sliced from a cylindrical ingot of silicon and which is lapped and polished before further processing. The electrical characteristics of this wafer substrate are determined by the doping type and concentration which take place during the crystal growing process. In this regard, the wafer 10 may comprise P-type silicon. The wafer 10 is shown as being partitioned into a large plurality of dice by the grid lines 12 illustrated on the upper surface of the wafer 10. FIG. 1 also illustrates a perspective drawing of an individual die separated from the wafer 10 following the various processing steps yet to be described. This die is indicated generally by numeral 14.

Figure 2:
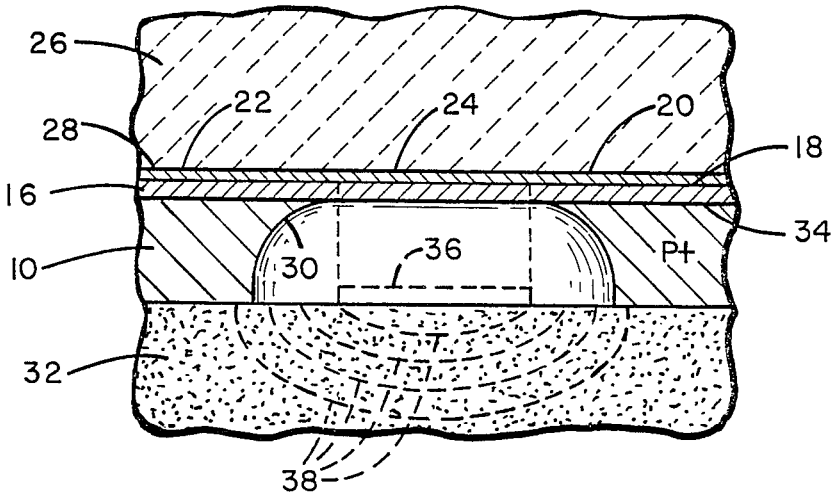
FIG. 2 is a cross-sectional view taken along the line 2—2 in FIG. 1.

With continued reference to FIGS. 1 and 2, the first step in the processing following the slicing of the silicon ingot into single-crystal substrates 10 is to grow an epitaxial layer of silicon on the top surface of the silicon wafer 10, that epitaxial layer being identified by numeral 16 in the greatly enlarged cross-sectional view of FIG. 2. The layer 16 may, typically, be about 25 microns in thickness, but limitation to this specific dimension is not to be inferred. This epitaxial layer may be grown in a conventional fashion using vacuum deposition or chemical-vapor deposition processes.

Following the formation of the epitaxial layer 16, a further oxide layer, having a thickness in the range of from 3,000 to 7,000 Angstroms, is grown on the epitaxial layer as an insulation, that layer being represented by line 18 in FIG. 2.

Next, metal contacts as at 20,22 in FIGS. 1 and 2 are deposited on the oxide layer to a thickness of about 2 microns with any excess metal being etched away to yield the desired shape pattern on the wafer.

Spanning the contacts 20,22 is a bridge member 24 which may be the same metal type as the contacts 20,22, in which event the bridge member 24 would be integrally formed with those contacts. Alternatively, and perhaps preferred, the bridge member 24 may be comprised of a higher density metal than that formed by the contracts. The objective is to achieve a higher flier velocity by using more mass in the bridge that is vaporized. The bridge member 24 may also comprise a heavily doped polysilicon.

To better direct the force of the pressure build-up upon vaporization of the bridge, a counter mass in the form of a Pyrex glass faceplate 26 may be bonded to the metallized oxide surface 18 using an epoxy, as at 28, as a bonding agent.

With reference to the cross-sectional view of FIG. 2, it may also be seen that each silicon die of the wafer 10 is first masked and then back-etched, as at 30, completely through the thickness dimension of the wafer 10 so as to expose the underside of the epitaxial layer 16. This simultaneous back-etching of the wafer (prior to separating into die) creates a "barrel" in each die through which a flyer travels following vaporization of the bridge and prior to its striking the secondary explosive pellet 32. The electro-chemical etch process employed etches away the unmasked silicon from the back side of the wafer and stops upon reaching the epitaxial layer interface 34. This generates a thin, uniform, silicon flyer that is in contact with the metal or polysilicon bridge member 24.

After the back-etching operation, the wafer is cut or diced where each die contains a bridge/barrel combination. The attachment of the Pyrex faceplate 26 as a backer plate or counter mass occurs subsequent to the dicing step.

When the device of the present invention is to be used to detonate a secondary explosive, a very low inductance, high voltage source, such as a charged capacitor, is connected to the contacts 20 and 22 of the detonator die. The application of this high voltage, typically about 2,000 volts, causes instantaneous vaporization of the bridge member 24. As the vaporization becomes complete, the resulting planar pressure shock wave that forms impinges upon the material of the epitaxial layer and shears that layer 16 at the barrel interface and propels the severed segment (flier) down the barrel 30, as represented by the dashed line disk 36 in FIG. 2. When the flyer 36 reaches the end of the barrel, it strikes the fine-grain HNS secondary explosive, creating shock waves which are represented by the concentric wave fronts 38 in FIG. 2. The shock wave, in turn, detonates the secondary explosive, which, in a typical application would in turn cause detonation of a main explosive charge, setting it off as well.

As suggested above, the Pyrex faceplate acts as a counter mass for directing the exploding bridge energy in the direction that the silicon flyer disposed beneath the bridge is to travel. Those skilled in the art will recognize that using the manufacturing techniques of the present invention, hundreds of detonator dies can be simultaneously mass produced using known deposition and etching techniques common to integrated circuit technology. Being entirely solid state, the detonator of the present invention possesses no mechanical moving parts which could fail.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A detonator device for use with high explosives, comprising:

(a) a silicon substrate having an epitaxial layer grown on one surface thereof;

(b) an insulating layer formed on the exposed surface of said epitaxial layer;

(c) a pair of metal contacts formed on said insulating layer with a predetermined spacing therebetween;

(d) a bridge member joined to and extending between said spaced contacts;

(e) said silicon substrate being back-etched in a zone beneath said bridge member substantially through the thickness of said substrate; and (f) a faceplate having a mass much greater than the mass of said epitaxial layer in the area overlaying said back-etched zone, said faceplate being affixed to the exposed surface of said pair of metal contacts and overlaying said bridge member.

2. The detonator device as in claim 1 wherein said bridge member is metal.

3. The detonator device as in claim 1 wherein said bridge member is a heavily doped polysilicon.

4. The detonator device as in claim 1 wherein said silicon substrate is P-type silicon and said epitaxial layer is N-type silicon.

5. The detonator device as in claim 4 wherein said insulating layer comprises silicon oxide and said faceplate is Pyrex glass of a thickness in the range of from 0.025 to 0.1 inch.

6. A method of producing a detonator device for use with high explosives, comprising the steps of:

(a) cutting a single crystal silicon wafer from a silicon ingot;

(b) forming an epitaxial layer of silicon on said wafer;

(c) forming an oxide insulation layer on the exposed surface of said epitaxial layer;

(d) depositing a plurality of metal contact pairs at discrete locations on the exposed surface of said oxide layer;

(e) forming a bridge member between each of said plurality of contact pairs;

(f) back-etching said silicon wafer through the thickness dimension thereof at locations disposed beneath each of said bridge members to form barrels at said locations;

(g) dividing said silicon wafer into a plurality of individual dies, each including said contacts, said bridge member and said back-etched barrels; and (h) bonding a counter mass to the face of each die in contact with said bridge member.

* * * * *